US012305956B2

(12) United States Patent
Walker

(10) Patent No.: US 12,305,956 B2
(45) Date of Patent: May 20, 2025

(54) OPTIMIZED FIREARM PANEL

(71) Applicant: Drew Nolle Walker, Mesa, AZ (US)

(72) Inventor: Drew Nolle Walker, Mesa, AZ (US)

( * ) Notice: Subject to any disclaimer, the term of this patent is extended or adjusted under 35 U.S.C. 154(b) by 190 days.

(21) Appl. No.: 17/719,376

(22) Filed: Apr. 13, 2022

(65) Prior Publication Data

US 2022/0325980 A1 Oct. 13, 2022

Related U.S. Application Data

(60) Provisional application No. 63/174,048, filed on Apr. 13, 2021.

(51) Int. Cl.
*F41C 23/18* (2006.01)
*F41C 23/10* (2006.01)
*F41C 23/16* (2006.01)

(52) U.S. Cl.
CPC ..... *F41C 23/18* (2013.01); *F41C 23/10* (2013.01); *F41C 23/16* (2013.01)

(58) Field of Classification Search
None
See application file for complete search history.

(56) References Cited

U.S. PATENT DOCUMENTS 2,331,372 A * 10/1943 Buchanan, Jr. ..... F41C 23/18 42/71.01
2,701,930 A * 2/1955 Dolan ..... F41C 23/00 42/71.01
4,346,530 A * 8/1982 Stewart ..... F41C 23/18 42/71.01
4,625,445 A * 12/1986 Ruger ..... F41C 23/10 D22/104
4,771,562 A * 9/1988 Ruger ..... F41C 23/10 D22/104
5,231,237 A * 7/1993 Cupp ..... F41C 23/10 42/71.02
7,823,319 B2 * 11/2010 Casas Salva ..... F41C 23/16 42/74
7,845,105 B1 12/2010 Cahill
7,856,749 B2 12/2010 Fitzpatrick et al.
7,937,874 B2 * 5/2011 Roth ..... F41C 23/10 42/72
D700,267 S * 2/2014 Barfoot ..... F41C 23/10 D22/108
D702,308 S * 4/2014 Glock ..... D22/108
8,935,874 B2 * 1/2015 Troy ..... F41G 11/003 42/96
9,222,749 B1 * 12/2015 Nakayama ..... F41A 35/02
D761,928 S * 7/2016 Adair ..... D22/108
9,441,905 B2 * 9/2016 Hines ..... F41A 35/00
9,587,905 B1 * 3/2017 Biedenbach ..... F41C 23/16
(Continued)

*Primary Examiner* — Gabriel J. Klein
(74) *Attorney, Agent, or Firm* — Mark V. Loen

(57) ABSTRACT

A detachable grip panel for a real or simulated firearm according to the present invention includes an onlaid or inlaid aggressively textured surface layer on top of an adhesive layer nested into a specially formed recessed area on the grip panel. Additionally, the recessed area along with other geometry of the grip panel may be configured to provide an aggressive gripping surface while reducing the tendency to snag. Furthermore, the recessed region along with the chosen adhesive may provide for an ultra-slim profile while also offering thermal insulation.

4 Claims, 13 Drawing Sheets

(56) References Cited

U.S. PATENT DOCUMENTS

| | | | | |
|---|---|---|---|---|
| 9,625,233 | B2 * | 4/2017 | Daniel | F41G 11/003 |
| 9,777,984 | B1 * | 10/2017 | Bonine | F41C 23/10 |
| 10,495,407 | B1 * | 12/2019 | Shelton | F41C 23/16 |
| 2011/0289812 | A1 * | 12/2011 | Losinger | F41C 23/10 42/72 |
| 2012/0085013 | A1 * | 4/2012 | Cahill | F41C 27/00 42/96 |
| 2017/0205183 | A1 * | 7/2017 | Ding | F41A 35/02 |
| 2017/0297059 | A1 * | 10/2017 | Pavlick | F41A 3/14 |
| 2017/0307328 | A1 * | 10/2017 | Shelton | F41C 27/00 |
| 2021/0080204 | A1 * | 3/2021 | Yeates | B29C 45/14336 |
| 2023/0147430 | A1 * | 5/2023 | Planck | F41A 3/72 42/124 |

* cited by examiner

OPTIMIZED FIREARM PANEL

REFERENCE TO RELATED APPLICATIONS

This application claims the benefit of provisional patent application Ser. No. 63/174,048 filed Apr. 13, 2021 by the present inventor. This referenced application is incorporated by reference herein.

FIELD OF INVENTION

The present invention relates firearm grip panels for use with real or simulated firearms.

BACKGROUND OF THE INVENTION

Traditional firearm panels or grips, made for use with real or simulated firearms, do little more than cover the area used when the shooter grips the firearm. They provide neither good thermal insulation nor an aggressively textured surface for the shooter to grab the panel and provide a solid grip. Additionally, incorporating inlaid or onlaid textured surface layer on firearm components or accessories can present significant challenges in terms of ease of manufacturing at scale or snagging on, and therefore, damaging nearby items such as clothing, skin, and equipment due to the abrasive nature of aggressively textured surface layers. Furthermore, when a firearm is discharged repeatedly, its barrel heats up and that heat propagates next to other areas of the firearm such as the areas used to grip the firearm. While current handguard or grip panels typically offer some nominal protection from the heat radiating from the firearm, they are constructed from a singular, homogenous material allowing for only a small degree of protection against heat for the shooter's hands. Additionally, handguard panels or grips are often secured to a firearm's handguard with metal mechanical fasteners. After repeated firing, the firearm's barrel transfers heat into these metal fasteners which are in close proximity to the shooter's hands, making a burn increasingly likely. Presently, there are no other handguard panels or grips successfully combining effective thermal resistance, an inlaid or onlaid aggressively textured surface layer or layers, and a means for minimizing the chances of having the textured surface layer cause snagging or damage.

SUMMARY OF THE INVENTION

A detachable grip panel for a real or simulated firearm according to the present invention includes an onlaid or inlaid aggressively textured surface layer on top of an adhesive layer nested into a specially formed recessed area on the grip panel. Additionally, the recessed area along with other geometry of the grip panel may be configured to provide an aggressive gripping surface while reducing the tendency to snag. Furthermore, the recessed region along with the chosen adhesive may provide for an ultra-slim profile while also offering thermal insulation.

DETAILED DESCRIPTION OF THE INVENTION

The present disclosure is directed to a firearm grip panel, or more generally, a detachable gripping surface—while not relegated only to handguards, the panel may be commonly referred to as a handguard panel or rail cover, as it will be the most common embodiment of it, but it may be also more succinctly referred to as a panel; the present disclosure is not limited to simply being affixed to a firearm's handguard as the name applies, but rather to any surface on a firearm the panel could mount upon which would be then used to grip (for example, the panel may also refer to a grip on a handgun). The panel may be affixed to the handguard of a real or simulated firearm. The handguard may take the form of various types common for use on firearms including but not limited to a Keymod rail, Picatinny rail, M-LOK rail, or a proprietary rail. It is contemplated that the panel may take the form of various lengths, widths, and shapes. The term firearm is synonymous with the term gun and also may mean any real or simulated ranged weapon. The panel may be affixed to the rails, frame, stock, or other engagement surfaces of a firearm. The panel may be used on its own or in conjunction with a plurality of additional panels. In its ideal embodiment, the panel incorporates one or more inlaid or onlaid aggressively textured surface layers (hereafter also referred to as simply a "textured surface layer") to engage the shooter's hand and provide a secure grip, provide effective thermal insulation for the shooter's hand, and minimize the snagging effect of the abrasive surface or surfaces on the panels. To clarify terminology, a textured surface layer is distinct from simply a surface with a rough texture in that a material distinct from the material of the panel base is added to it, making it a more abrasive surface to the touch. To additionally clarify, a panel base is the collective portion of the panel upon which one or more adhesive layers are placed (followed then by one or more textured surface layers). For example, the material of the panel base may be a polymer, but the adhesive layer may be an epoxy resin, and the inlaid textured surface layer may be silicon carbide grit ("grit" may also refer to granules). In an exemplary embodiment, and to achieve enhanced thermal resistance and grip offered to the shooter's hand, the panel may utilize an adhesive layer such as an epoxy resin, which ideally is thermally nonconductive, that covers a substantial portion of the panel base and is then covered with an aggressively textured surface layer such as (but not limited to) silicon carbide or boron carbide granules (or, for example, even a combination of several different blast media to achieve desired characteristics).

It is an aspect of this panel to provide one or more abrasive surface layers that are joined on a permanent or semi-permanent manner to the area of the panel being gripped by the shooter. The textured surface layers may be constructed using various blast media (e.g. the type of material used in sandblasting) such as permanently adhering granules of silicon carbide to the panel. The textured surface layer must be of a different material from the rest of the panel. Various materials, blast media, etc. such as boron carbide granules may be used for the textured surface layer. Epoxy or another strong adhesive may be used to adhere to the panel base. Grit size for the blast media or material to have adhered to the panel base may be adjusted for the level of severity of the abrasiveness desired. Alternatively, for a more rugged variation of a textured surface layer, molten or highly heated metal globules may be sprayed on the desired area of the panel's surface so that, when fully cooled, the surface now contains an inlaid abrasive texture using metal bumps fused into the surface of the panel, effectively combining an adhesive and an abrasive texture together using a molten or near molten state. In yet another alternative embodiment, it is contemplated that certain grip tapes combine a textured surface layer comprising of granules similar to blast media on top of an adhesive layer.

It is another aspect of the invention to couple the "grippyness" of a textured surface layer that is aggressively abrasive with special geometric configurations on the panel itself that allows the shooter to achieve a firm, secure grip on the panel while also minimizing the chance of the textured surface layer causing a snag. This may be accomplished by recessing areas (which also may be referred to as a "dug-out" or "recessed region") on the panel base and using those recessed areas to place an adhesive layer followed by abrasive material to form a textured surface layer. For example, an adhesive such as an epoxy resin could be smeared into the recessed area and then covered by an abrasive blast media such as loose silicon carbide granules, which upon the epoxy curing would solidify the silicon carbide granules in place, thereby forming one embodiment of the textured surface layer. The result would be an inlaid textured surface layer that retracted inwards toward the panel base requiring the shooter's hands to actively engage the inlaid textured layer to experience its benefits, whereas a more glancing, less deliberate grip may brush over the textured surface layer. A recessed, or "dug-out" area on the panel limits the ability for the abrasive texture of the panel to snag unintentionally on nearby objects without compromising the "grippy-ness" provided by the abrasive areas. The depth of the dug-out area or areas on the panel, coupled with the height of the adhesive layer or layers (i.e. how much adhesive is being used corresponds to adjusting the height of an adhesive layer) may be altered to allow the textured surface layer or layers to be more concealed from unintentional snagging by using only enough adhesive along with only enough material (whatever media is being used for the textured surface layer, e.g. silicon carbide) to ensure the top plane of the textured surface layer is just vertically below the top plane of the panel or at least highly proximal to it (and therefore the combined, predetermined heights of the textured surface layer and the adhesive layer are approximately equal to or less than the depth of the recessed area. The recessed areas also have the added benefit of slimming the overall profile of the panel and lowering its overall weight. Incorporating textured surface layers without recessed or dug-out areas may add to a perception that the panel appears too thick in some cases.

Additionally, the effect of having an inlaid textured surface layer that allows a secure gripping surface while also minimizing the likelihood of snagging may be achieved through the use of mound-like ridges that are placed nearby the inlaid or onlaid textured surface layer and may surround the textured surface layer on one or more sides. The ridges provide a protective barrier and create a gap between the shooter's hand or another nearby object and the inlaid textured surface layer. The ridges force the shooter to grab the panel more deliberately but still provide the benefit of a secure grip upon engaging the textured surface layer while minimizing the chance of a snag. The ridges nudge away items such as clothing or a seatbelt that would readily be snagged by the inlaid textured surface layer. The height of the mound-like ridges may be increased to accentuate this effect. These mound-like ridges may also be referred to as "anti-snag ridges".

Another aspect of the invention is its ability for providing for a simple and non-labor-intensive method of applying the textured surface layer or layers of the panel to one or more recessed regions. Applying a textured surface layer using an adhesive such as epoxy can be difficult and requires precision so that the adhesive does not stray outside its intended area and maintains a clean, sharp appearance. If a technique of using masking tape or liquid masking tape paint to mask off all but the recessed region or regions is being used, using deep, thin trenches placed along the very edges of a recessed region allows for the precise masking-off of recessed regions on the panels so they may be filled with an adhesive and abrasive media. In most cases where this technique is employed, a deep, thin trench approximately 0.25-0.5 mm wide and 1.0-2.0 mm deep may be sufficient. Masking off the correct area is accomplished more easily because these deep thin trenches are intended to engage the sharp pointed edge of a blade thereby allowing a knife or similar tool to cut out a specific area of the masking tape, revealing a very precise area to be filled with adhesive and abrasive media such as silicon carbide (thereby forming the adhesive layer and textured surface layer) without having any unsightly adhesive residue outside of the recessed region.

Alternatively, if a technique of directly applying the adhesive and abrasive media is used (i.e. without using masking tape), it may be difficult to accurately and neatly apply both substances. To assist with this, the boundary walls of the recessed region may be abrupt and straight up and down to allow for an adhesive to be slathered only within a recessed region while preventing it from pooling up and spilling over to other areas of the panel outside the recessed region. Alternatively, the walls of the recessed region may be inclined inward forming a dovetail-like area, thereby allowing the walls to incline slightly over the recessed area, forming a region of the inclined walls that overhang the recessed region. A recessed region having these inclined walls that vertically overhang the recessed region would make it very easy to apply an adhesive such as an epoxy resin to the recessed region while making it much more difficult to mistakenly get adhesive residue outside of the recessed region. It is also contemplated the inclined walls may be curved as opposed to straight. Either feature has the significant advantage of avoiding the need for masking off areas of the panels and may be used for recessed regions that require precision and fine detail without the cost and preparation time involved in masking areas off. To assist further with applying adhesive without using masking tape, the panel may also feature a shallow trench proximal to the boundary walls of the recessed region but within the recessed region itself. This will allow a deliberate place for the adhesive to pool so it will be less likely to cling to the top-most portion of the boundary walls of the recessed region. In most cases where this technique is employed, a shallow trench approximately 2.0 mm wide and 0.5 mm deep may be sufficient.

It is additionally contemplated that in some scenarios, it would be advantageous to have an embodiment where the panel makes use of an onlay versus an inlay. In an onlaid textured surface layer to maximize the area of gripping surface and where overall thickness may be less of a concern. An onlay method of applying a textured surface layer refers to either a lack of a recessed region, a shallow recessed region, or, simply, the use of a taller combined predetermined height of the adhesive layer and textured surface layer that is vertically taller than the top plane of the panel. In the case of an onlay method being used, deep thin trenches may be proximal to the edges of where the adhesive layer must go to allow for easy masking-off of the area. Additionally, if an onlaid method is used, regardless of how it is achieved (again, it may be by way of a shallow recessed region, no recessed region, more adhesive being used resulting in a taller adhesive layer, etc.), unintentional snagging may be reduced using mound-like ridges placed proximal to the textured surface layer.

It is yet another aspect of the invention to incorporate the ergonomic needs of the shooter into the panels. The panel provides abrasive areas strategically with respect to how the shooter may wish to obtain an optimal grip on the panel while affixed to a firearm's handguard. For example, the shooter may use a thumb-over-bore technique to obtain a high degree of control on their rifle when firing. In doing so, they may rest their thumb or another finger on a specific area on the handguard. In one embodiment of the panel, the panel may feature a textured area made to readily engage the shooter's thumb to provide a "grippy" texture to the area of the panel that would most likely engage that specific area. Additionally, the textured surface layer may be applied over a recessed area with an area on the recessed area that is further recessed, or wherein the recessed area is generally curved in an approximately concave shape causing the adhesive layer to follow the curvature of the recessed area's lowest point and result in a curved shape, therefore, for the textured surface layer—this curved textured surface layer provides more surface area for the shooter's finger to engage and therefore a more secure grip.

On the topic of incorporating the ergonomic needs of the shooter, the outward-facing (i.e. towards the shooter's hand or the "grip side") surface of the panel may feature an incline upon which is featured a textured surface layer so as to engage the shooter's hand more directly when grasping the panel. In effect, the incline causes the shooter's hand to apply more direct pressure to the textured surface layer. An embodiment of a panel utilizing an inclined outward-facing surface may, in its ideal form, use an angle between 5 to 30 degrees—the greater the angle, the more pressure directly applied by the textured surface layer into the shooter's hand.

Additionally, it is an aspect of the invention to insulate the shooter's hand from heat. This may come in several forms including but not limited to constructing the panel base itself from multiple materials or multiple layers of different materials. It is contemplated that the panel base may be made using additive manufacturing wherein, for example, a singular material such as nylon or multiple materials such as carbon fiber and Kevlar (or another aramid fiber) are interwoven to slow the transfer of heat. Additionally, it is also contemplated that the panel base may be made from glass-reinforced nylon or a temperature-resistant polymer with a relatively high heat deflection point using an injection molding process. While the panel base itself may be constructed of various materials such as polymers, composites, aramids, and even metals, it is contemplated that the panel, in its exemplary embodiment utilizes an adhesive to form an adhesive layer and adhere abrasive media to the panel wherein the adhesive is relatively thermally non-conductive (for example, some epoxy resins have a low thermal conductivity) and has a high melting point given that the panel may need to be in close proximity to a heated barrel or gas block. Additionally, the blast media or abrasive (for simplicity this may be any abrasive material or media chosen to impart an aggressive texture) may be chosen for its insulative effects against heat. For example, boron carbide granules have a low level of thermal conductivity (as opposed to silicon carbide which is more thermally conductive), which, especially if used in conjunction with an epoxy resin which also has low thermal conductivity and a high melting point, will be highly effective in insulating the shooter's hands from heat transfer and potential burns. It is additionally contemplated that, in a non-limiting embodiment, a thermal barrier, which ideally would be a material that has a low level of thermal conductivity than other materials comprising the panel itself is composed of, may be placed within the panel itself to act as a thermal barrier. This thermal barrier being placed within the panel resists thermal transfer as heat propagates through the panel and out towards the shooter's hand. The thermal barrier may also be deployed at the portion of the panel that interfaces directly with the handguard (at the vertical bottom-most point of the panel). In this capacity, the thermal barrier also may act as a radiant heat reflector. In a non-limiting embodiment, the thermal barrier insert is made from a metal or ceramic, and alternatively may be made from a vacuum chamber, an air pocket, epoxy resin, aerogel, acrylic, or other insulative substances.

Lastly, protection of the shooter's hand from heat may come in the form of strategically placed mounds in close proximity to a fastener or fasteners used to secure the panel to the handguard. Fasteners including but not limited to metallic M-LOK T-nuts, screws, etc. heat up faster than the panel itself. The shooter's hand could contact the metal fastener itself, potentially resulting in a burn. These mounds would surround some or all of a fastener's outer edge providing a protective barrier and creating a gap between the skin of the shooter's hand and the metal of the fastener.

DRAWINGS—REFERENCE NUMERALS

Figure 1:
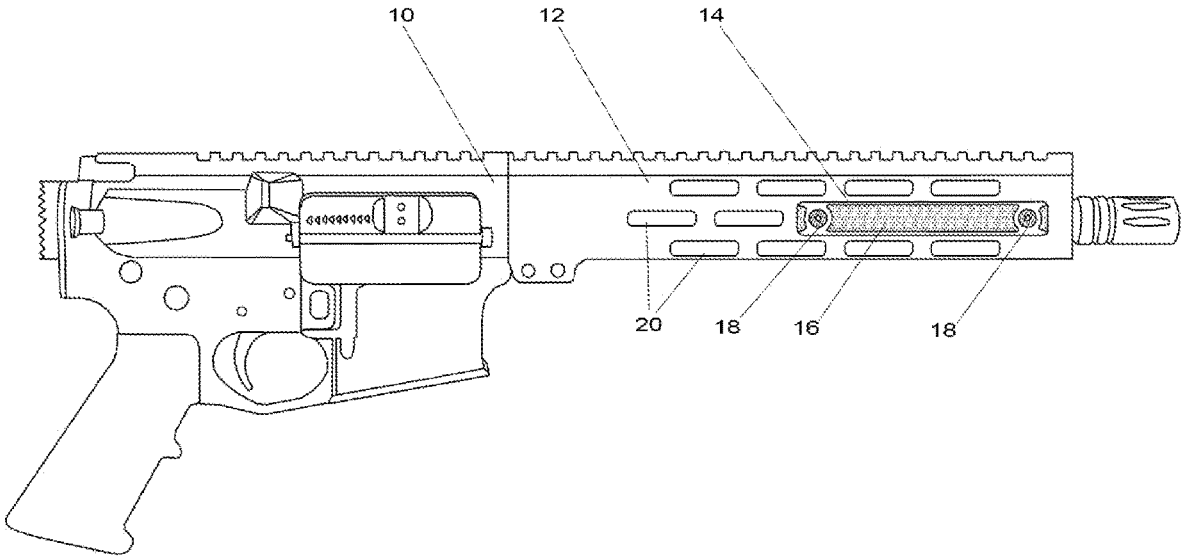
FIG. 1 shows an embodiment of the handguard panel affixed to the handguard of a gun.

10 gun
12 handguard
14 panel
16 textured surface layer
18 fastener
20 panel interface point
22 horizontal axis
24 vertical axis
26 lateral axis
28 mound
30 adhesive layer
32 recessed region wall
34 panel base
36 recessed region
40 top of recessed region wall
42 gun interface region

44 deep trench
46 shallow trench
48 inclined walls
50 top of the inclined wall
52 thermal barrier
54 anti-snag ridge
56 raised panel base
58 inclined outward-facing surface
60 hand-stop
62 curved recessed region
64 handgun
66 handgun grip region

DETAILED DESCRIPTION OF THE DRAWINGS

In FIG. 1, a gun 10 having a handguard 12 is depicted with an embodiment of the panel 14 as a handguard panel (also referred to more simply as "the panel") at a side view. In this view, the panel 14 can be seen in the context of how it may be commonly embodied. While the handguard 12 depicted here is of the M-LOK variety, various other handguard types may be used as this is not a limiting factor for how the panel 14 may interface with the handguard 12. The handguard 12 may also be referred to as a panel engagement region. The panel 14 covers an area of the handguard 12 and provides a conspicuous place for the shooter's hand (not shown) to grip. Additional anatomy may be seen on this view, such as the textured surface layer 16 and fasteners 18 which affix the panel 14 to the handguard 12. In this embodiment, the textured surface layer 16 is inlaid into a recessed region (not shown) of the panel 14. While the length of the panel 14 is shown to be relatively long compared to its width, it is contemplated the panel 14 may be various sizes in terms of length and width. Additionally, in this view, this embodiment of the panel 14 is installed onto a handguard 12 having multiple panel interface points 20 with which the handguard panel 14 affixes itself to the handguard 12 via fasteners 18. A panel interface point 20 is depicted in FIG. 1 as an M-LOK slot but it may refer to any feature or anatomy designed to engage a panel including but not limited to common accessory interface standards such as Keymod, Picatinny, etc.

Figure 2:
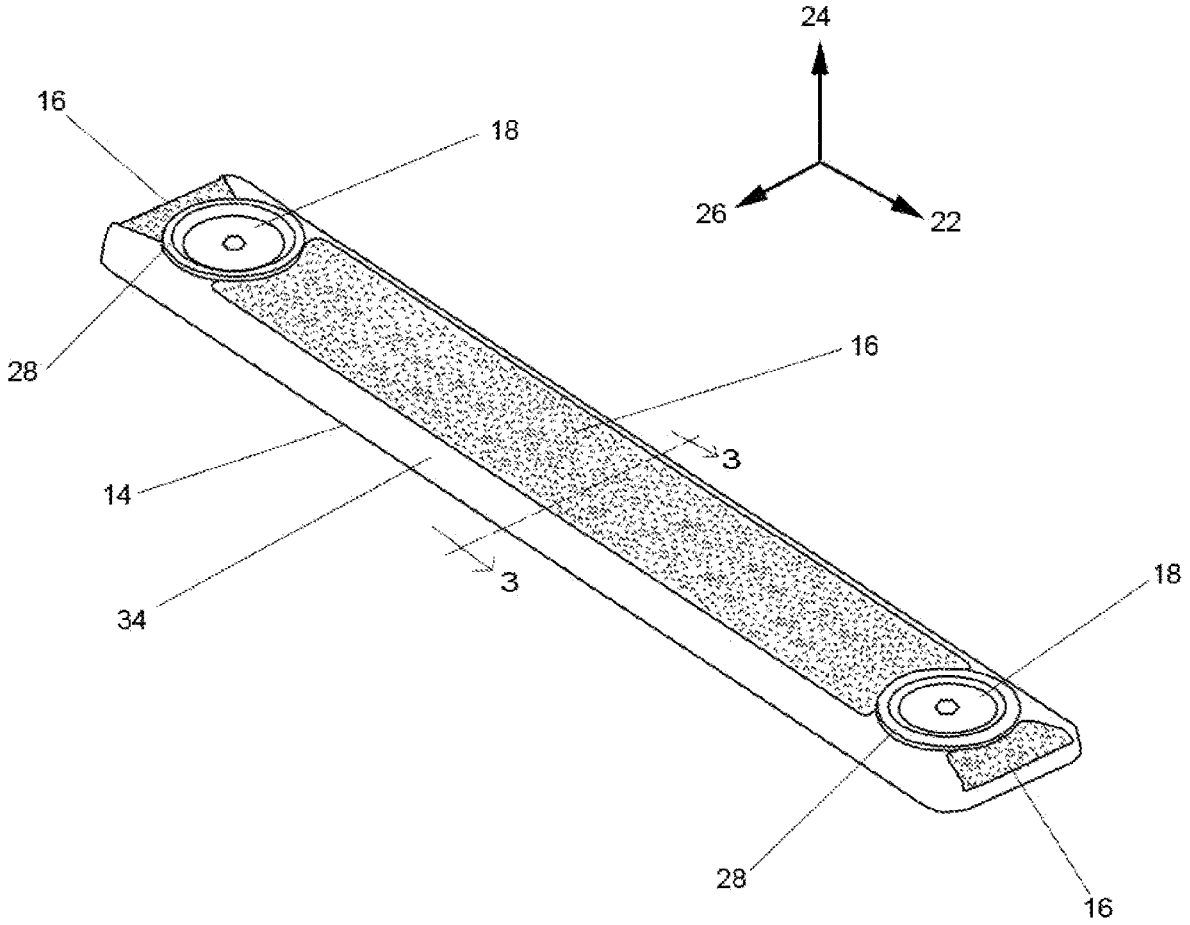
FIG. 2 shows a perspective view of the embodiment of the panel in FIG. 1 isolated with axes defined.

In FIG. 2, a perspective view of the embodiment of the panel 14 in FIG. 1 is isolated with axes defined. To assist in this description, an axes system is defined whereby the arrow at 22 indicates the horizontal axis, the arrow at 24 indicates the vertical axis, and the arrow at 26 indicates the lateral axis. In this embodiment, the panel 14 has a plurality of textured surface layers 16 on the vertical top-most surface of the panel 14. It is contemplated that the textured surface layers 16 may be comprised of one or more grits of silicon carbide blast media or boron carbide blast media that is permanently attached to the panel 14 via an epoxy-like adhesive (not shown). In this embodiment, it is further contemplated that an aggressive grade of grit such as silicon carbide granules in 60 grit may comprise the textured surface layers 16 to achieve a notably abrasive surface that gives the shooter's hand (not shown) the ideal gripping surface, though this specific grit is not a limiting aspect of the panel 14. As a non-limiting alternative to silicon carbide, boron carbide, aluminum oxide, or other blast media may alternatively be used for the texture of the textured surface layer 16. Different materials for the textured surface layer 16 may be chosen to impart additional advantages beyond simply being abrasive; for example, not only does boron carbide provide an abrasive surface, but it is thermally non-conductive relatively speaking—this characteristic will further resist heat propagating through the panel 14.

In this embodiment, the panel 14 additionally comprises of a panel base 34, fasteners 18, and mounds 28 surrounding the fasteners 18. While this embodiment depicts two fasteners 18 and two mounds 28, it is contemplated that the panel 14 may comprise one or more fasteners 18. The fasteners 18 serve to secure the panel 14 handguard (not shown). While the fasteners 18 are depicted as screws in this embodiment, the fasteners 18 may comprise of any common hardware type or commonly accepted attachment method (e.g. MLOK, Keymod, snapping into place from the bottom without the use of screws, quick disconnect, etc.) to fasten a panel 14 to a handguard (not shown). The mounds 28 are depicted immediately surrounding the fasteners 14 and serve to distance the shooter's hand (not shown) from easily touching the fasteners 18 themselves which may become hot during rapid fire. Additionally, the vertical top-most portion of the mounds 28 are vertically higher than the top-most portion of the fasteners 18. In an exemplary embodiment, the difference in vertical height between the top-most portion of the fasteners 18 and the mounds 28 create an empty space just above the fasteners 18 that allows the shooter's hand (not shown) to potentially place a finger (not shown) right on top of the mound 28 and use it as an indexing point while also lowering the likelihood of burning the finger.

Figure 3:
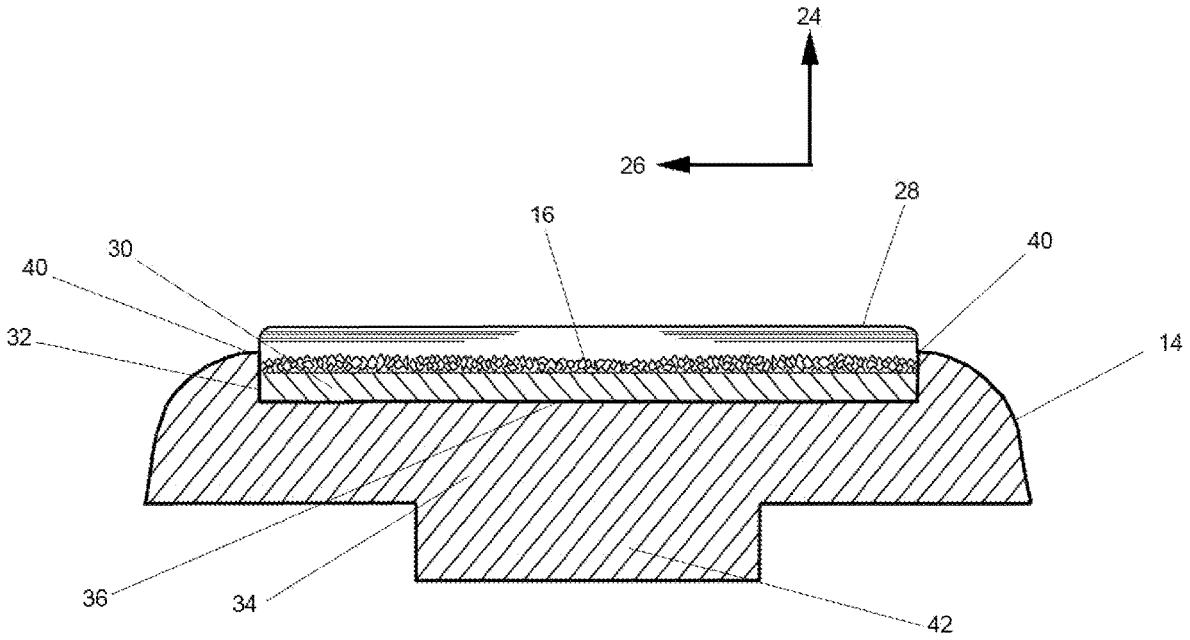
FIG. 3 shows a sectional view of the embodiment of the panel in FIG. 2.

FIG. 3 shows a sectional view of the embodiment of the panel 14 in FIG. 2 taken at the sectioning plane and in the direction indicated by section lines 3-3. From this view, additional anatomy can be seen. To assist in this description, an axes system is defined whereby the arrow at 24 indicates the vertical axis and the arrow at 26 indicates the lateral axis. The panel 14 features a textured surface layer 16 vertically above and adjacent to an adhesive layer 30. Both the textured surface layer 16 as well as the adhesive layer 30 reside inside a recessed region 36—in this configuration, the textured surface layer 16 is said to be inlaid because it is embedded into the recessed region 36 on top of the adhesive layer 30. The inlaid textured surface layer 16 is bonded to the adhesive layer 30 on a permanent or nearly permanent manner. The textured surface layer 16 may comprise of silicon carbide granules in one or more grit sizes or boron carbide granules in one or more grit sizes—or a combination of both types of granules. The adhesive layer 30 may comprise of a permanent or mostly permanent adhesive with low thermal conductivity such as a one or two-part epoxy resin. Additionally, the adhesive layer 30 firmly binds the textured surface layer 16 with the recessed region 36 at the panel base 34 and the recessed region wall 32. In the embodiment of the panel 14 disclosed in FIG. 3, it is anticipated that the adhesive layer 30 could be applied with a small brush (not shown) and spread throughout the recessed region 36 without the need for masking tape (not shown).

For additional clarity, the panel 14 refers to the entirety of the assembly of all components comprising it, whereas the panel base 34 refers to the area beneath the adhesive layer 30 and extends down to the vertical bottom of the panel to the gun interface region 42. As the name implies, the gun interface region 42 is the portion of the panel 14 that would directly connect with a gun (not shown), and likely via the handguard (not shown) at its panel interface point (not shown). For additional clarity, the vertical bottom-most portion of the panel 14 wherein the gun interface region 42 is located can be referred to as the attachment side, and the vertical top-most side of the panel 14, where the textured surface layer 16 is located as the gripping side. It is anticipated that the panel base 34 may be comprised of temperature-resistant polymers, nylon, G10, or other commonly used materials though these examples are not a limitation of what the panel base 34 may be made from. The top of the recessed region wall 40 is very close relative to the vertical position of the top-most portion of the textured surface layer 16—this relationship provides a key advantage. The top of the recessed region wall 40 being close in vertical height to the top-most portion of the inlaid textured surface layer 16 prevents whatever comprises the textured surface layer 16 (whether that is silicon carbide granules or another aggressively abrasive surface) from making the panel 14 too large and thick in appearance. Additionally, this relationship reduces the occurrences of the textured surface layer 16 snagging or scratching objects (not shown) such as clothing that may brush by the panel 14. If the possibility of snagging on the inlaid textured surface layer 16 must be minimized, the vertical height of the top-most portion of the textured surface layer 16 may be decreased relative to the top of the recessed region wall 40 to the point where the top-most portion of the textured surface layer 16 is beneath the top of the recessed region wall 40. It is anticipated that this relationship can also be adjusted, for example, to offer additional grip. In that case, the top-most portion of the textured surface layer 16 may increase in vertical height relative to the top of the recessed region wall 40, thereby giving the textured surface layer 16 greater exposure.

Figure 4:
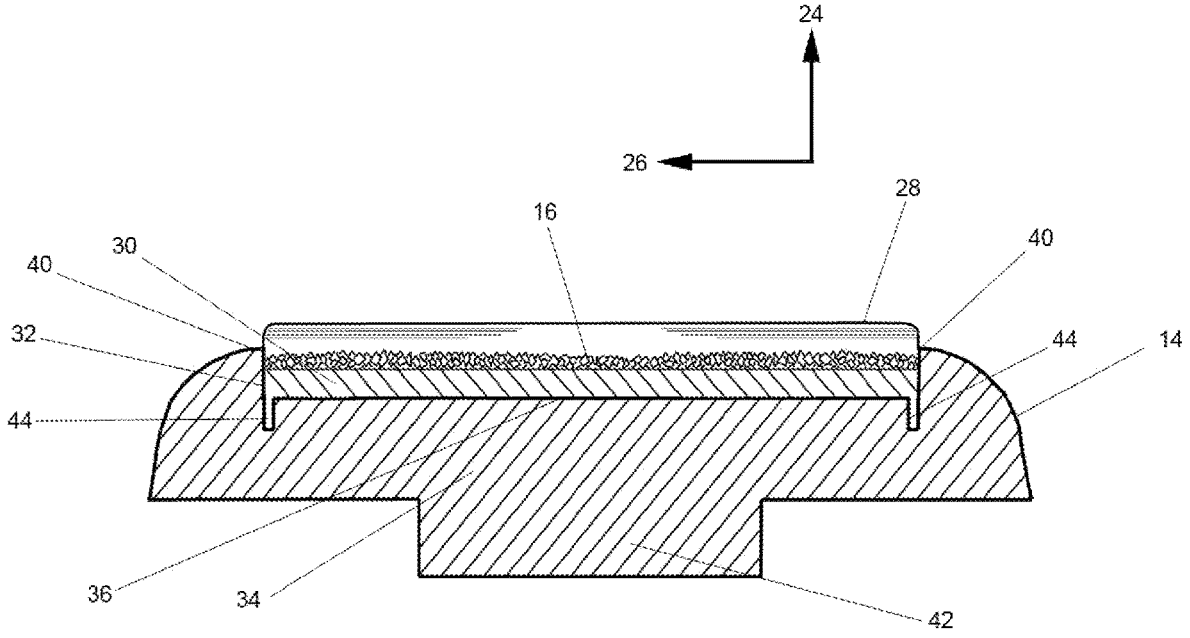
FIG. 4 shows a sectional view of an alternative embodiment of the panel in FIG. 2 with deep trenches.

FIG. 4 shows a sectional view of an alternative embodiment of the panel 14 in FIG. 2 taken at the sectioning plane and in the direction indicated by section lines 3-3. To assist in this description, an axes system is defined whereby the arrow at 24 indicates the vertical axis and the arrow at 26 indicates the lateral axis. The panel base 34 features a deep trench 44 that is characterized by being substantially proximal to the recessed region wall 32 and vertically beneath the adhesive layer 30. The deep trench 44 is envisioned to be vertically deep yet thin in terms of lateral width. When the panel 14 is being manufactured and the desired technique to add in the adhesive layer 30 and the textured surface layer 16 to the panel 14 is to use masking tape (not shown) or a similar item by masking off a recessed region 36, the primary purpose of the deep trench 44 is to engage the sharp point of a knife (not shown). When the knife's sharp point pierces through the masking tape, the user can then drag the knife's edge along the deep trench 44 within the recessed region 36, thereby using it as a highly precise guide. The result will be an efficiently masked-off panel 14 wherein the adhesive (such as a two-part epoxy, for example) comprising the adhesive layer 30 can be spread or slathered into the recessed region 36, followed by adding the granules of media that comprise the textured surface layer 16 (such as silicon carbide or boron carbide 60-grit granules, for example) in such a way that when the masking tape is removed from the panel 14, the result is a textured surface layer 16 with lines and edges that are very clean in aesthetic appearance.

Figure 5:
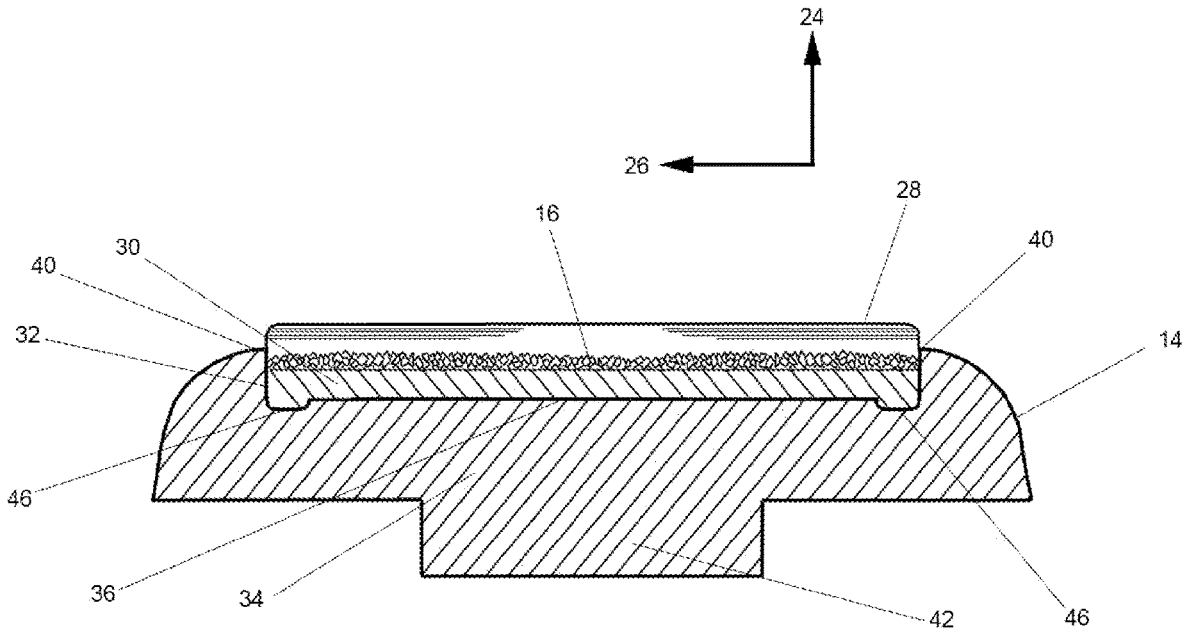
FIG. 5 shows a sectional view of an alternative embodiment of the panel in FIG. 2 with shallow trenches.

FIG. 5 shows a sectional view of an alternative embodiment of the panel 14 in FIG. 2 taken at the sectioning plane and in the direction indicated by section lines 3-3. To assist in this description, an axes system is defined whereby the arrow at 24 indicates the vertical axis and the arrow at 26 indicates the lateral axis. The panel base 34 features a shallow trench 46 that is substantially proximal to the recessed region wall 32 and vertically beneath the adhesive layer 30. The shallow trench 46 may be vertically shallow yet laterally wide with gentle edges as the recessed region 36 transitions into the shallow trench 46. When the panel 14 is being manufactured and the desired technique to add in the adhesive layer 30 and the textured surface layer 16 to the panel 14 includes avoiding the use of masking tape (not shown) or a similar item by masking off a recessed region 36, the primary purpose of the shallow trench 46 is to easily allow the adhesive (such as a two-part epoxy, for example) comprising the adhesive layer 30 to be spread or slathered into the recessed region 36 using a small brush or toothpick-like tool (not shown). The gentle sloping of the shallow trench 46 allows the spreading of the adhesive layer 30 to "pool" and collect at a lower point (i.e. at the bottom of the shallow trench 46) so that when the adhesive layer 30 is spread into and pushed up against the recessed region wall 32, the adhesive layer 30 tends not to cling as vertically high up on the recessed region wall 32. It is the role of the shallow trench 46 to make the adhesive layer 30 more difficult to adhere to the top of recessed region wall 40 as simply spreading the adhesive layer 30 within the recessed region 36 tends to have the adhesive layer 30 "bulge" upward when being pushed up against the recessed region wall 32. If this bulge occurs (not shown) with the adhesive layer 30, when it comes time to apply the textured surface layer 16, will not allow the textured surface layer 16 to have a uniform or professional appearance and may cause it to wear unevenly. In short, the shallow trench 46 facilitates the application of the adhesive layer 30 without the need to mask off the recessed region 36 while also making it more difficult for the adhesive layer 30 to be applied accidentally on the areas of the recessed region walls 32 that are too close to the top of the recessed region wall 40. In short, using a shallow trench 46 in close proximity to the recessed region walls 32 helps ultimately to ensure a neat, clean, and professional-looking textured surface layer 16 without the need to mask of the recessed region 36, thereby saving significant time and money during the manufacturing of the panel 14.

Figure 6:
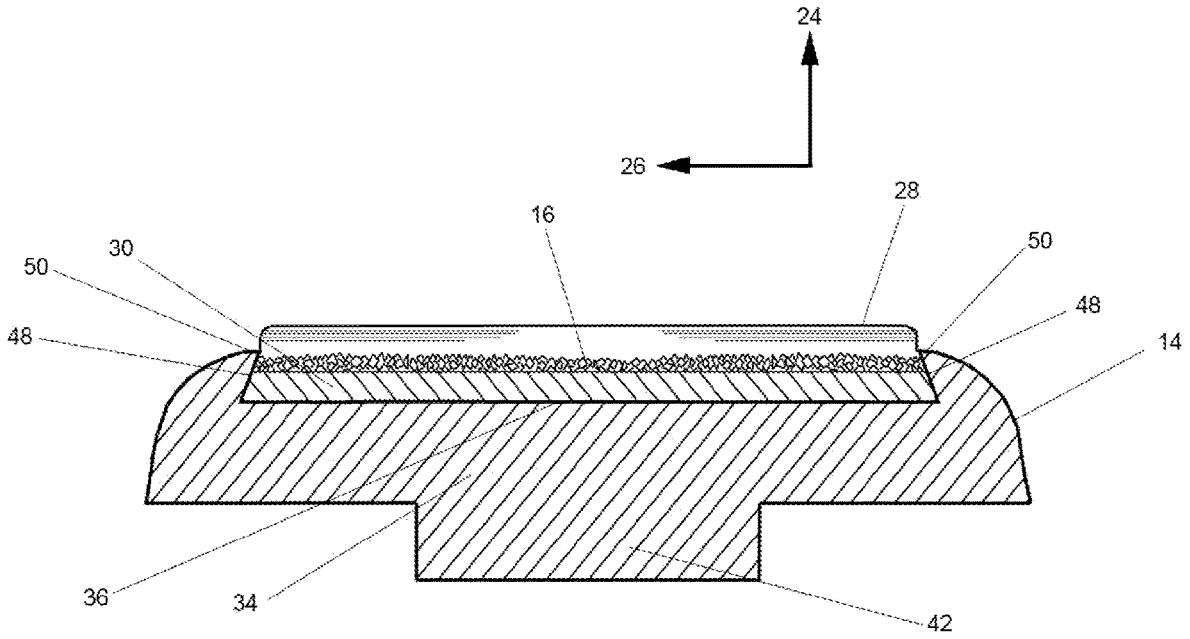
FIG. 6 shows a sectional view of an alternative embodiment of the panel in FIG. 2 with inclined walls.

FIG. 6 shows a sectional view of an alternative embodiment of the panel 14 in FIG. 2 taken at the sectioning plane and in the direction indicated by section lines 3-3. To assist in this description, an axes system is defined whereby the arrow at 24 indicates the vertical axis and the arrow at 26 indicates the lateral axis. The panel base 34 features inclined walls 48 for the recessed region 36. The top of the inclined wall 50 inclines toward the recessed region 36 and laterally overhangs a small portion of the inlaid textured surface layer 16 and adhesive layer 30. The inclined walls 48 provide a key advantage for large scale production of the panel 14 by allowing the adhesive layer 30 to be applied to the recessed region 36 and pushed directly up against the inclined walls 48, making it virtually impossible for the adhesive layer 30 to be spread too high up the inclined wall 48 (thereby preventing the adhesive layer 30 from bulging). The inclined walls 48 allow for the application of the adhesive layer 30 to be rapidly accomplished and naturally allow for the textured surface layer 16 to be quickly applied without the need for masking off regions of the panel 14 or requiring a tedious, slow pace of fabrication—all the while allowing for an ultra-clean, professional aesthetic for where the textured surface layer 16 has been applied.

Figure 7:
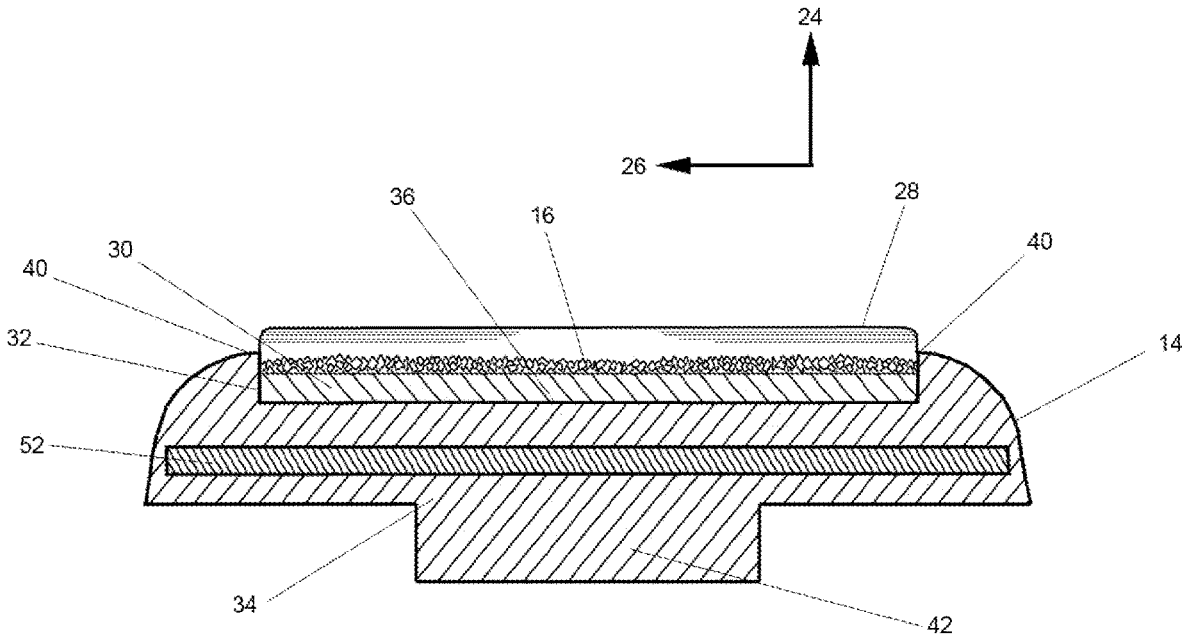
FIG. 7 shows a sectional view of an alternative embodiment of the panel in FIG. 2 with a thermal barrier.

FIG. 7 shows a sectional view of an alternative embodiment of the panel 14 in FIG. 2 taken at the sectioning plane and in the direction indicated by section lines 3-3. The panel 14 features a thermal barrier 52 within the panel base 34. To assist in this description, an axes system is defined whereby the arrow at 24 indicates the vertical axis and the arrow at 26 indicates the lateral axis. It is anticipated that the thermal barrier 52 may be made from a material of low thermal conductivity but it is not a requirement. Being positioned within the panel base 34, the thermal barrier 52 has the purpose of slowing the propagation of heat through the panel 14 and minimizing the heat transfer into the shooter's hand (not shown). The thermal barrier 52 may be made from many elements including but not limited to an epoxy resin, a vacuum (void), a vacant area (such as an air pocket), a sealed gas-filled area, aerogel, etc. It is anticipated that the thermal barrier 52 may also be located at the very vertical bottom of the panel base 34 where it would serve as a radiant barrier in that it would reflect radiant heat coming from the gun (not shown) and handguard (not shown) the panel 14 is attached to. It is anticipated that if the thermal barrier 52 is being used as a radiant barrier, it may be made from, but is not limited to, aluminum or another polished metal.

Figure 8:
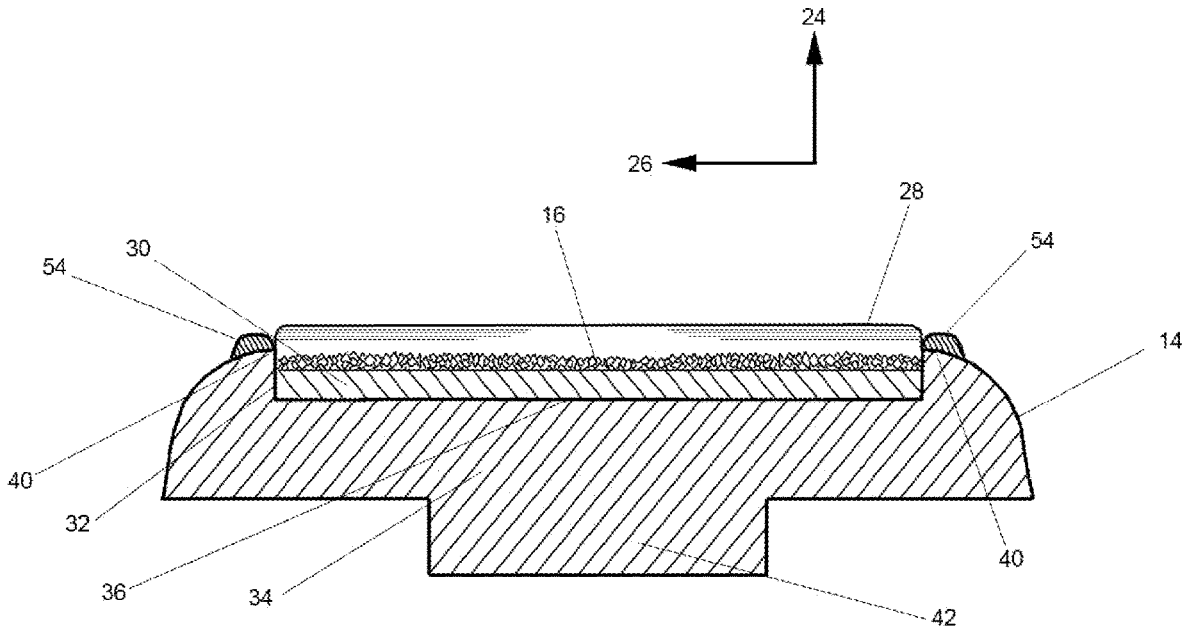
FIG. 8 shows a sectional view of an alternative embodiment of the panel in FIG. 2 with anti-snag ridges.

FIG. 8 shows a sectional view of an alternative embodiment of the panel 14 in FIG. 2 taken at the sectioning plane and in the direction indicated by section lines 3-3. The panel 14 features an anti-snag ridge 54. To assist in this description, an axes system is defined whereby the arrow at 24 indicates the vertical axis and the arrow at 26 indicates the lateral axis. The anti-snag ridge 54 may be described as a vertically short mound-like ridge proximal to the textured surface layer 16 whose placement may be vertically above the recessed region wall 40. Additionally, the anti-snag ridge 54 may be vertically higher than the top-most portion of the textured surface layer 16. In its ideal configuration, the anti-snag ridge 54 is approximately 1-2 mm above the top-most portion of the textured surface layer 16 and surrounds it on all sides. The greater the difference in vertical height between the anti-snag ridge 54 and the top-most portion of the textured surface layer 16 (where the anti-snag ridge 54 is vertically higher than the top-most portion of the textured surface layer 16), the more difficult it is for the textured surface layer 16, whose surface is comprised of an aggressively abrasive substance, to accidentally snag a nearby item (not shown) such as clothing.

Figure 9:
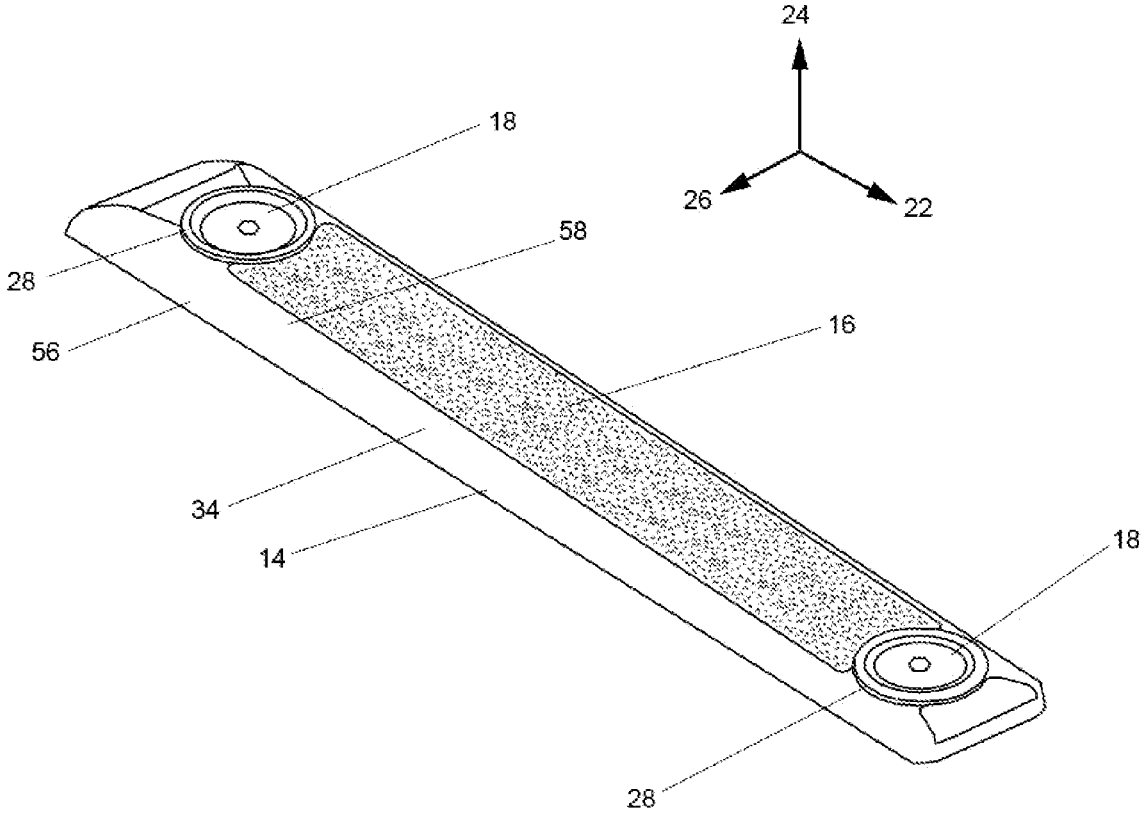
FIG. 9 shows a perspective view of an alternative embodiment of the panel in FIG. 2 with a raised panel base.

FIG. 9 shows a perspective view of an alternative embodiment of the panel 14 in FIG. 2 with a raised panel base 56. To assist in this description, an axes system is defined whereby the arrow at 22 indicates the horizontal axis, the arrow at 24 indicates the vertical axis, and the arrow at 26 indicates the lateral axis. For clarity in describing the raised panel base 56, there is only one textured surface layer 16 present on this embodiment. The raised panel base 56 causes the textured surface layer 16 which is inlaid on the inclined outward-facing surface 58 to incline at an angle. When the shooter's hand (not shown) engages the textured surface layer 16 while the panel 14 is installed on a firearm's handguard (not shown), the inclined nature of the textured surface layer 16 allows the shooter's hand to achieve a more secure grip and a therefore control the firearm (not shown) more easily. It is contemplated that the raised panel base 56 would raise up the maximum vertical height of the panel 14 by several millimeters and may cause the inclined outward-facing surface 58 have an inclined angle of between 5-30 degrees, though the inclined outward-facing surface 58 is not limited to that angle range. The higher the angle of the inclined outward-facing surface 58, the more aggressively the textured surface layer 16 engages the shooter's hand.

Figure 10:
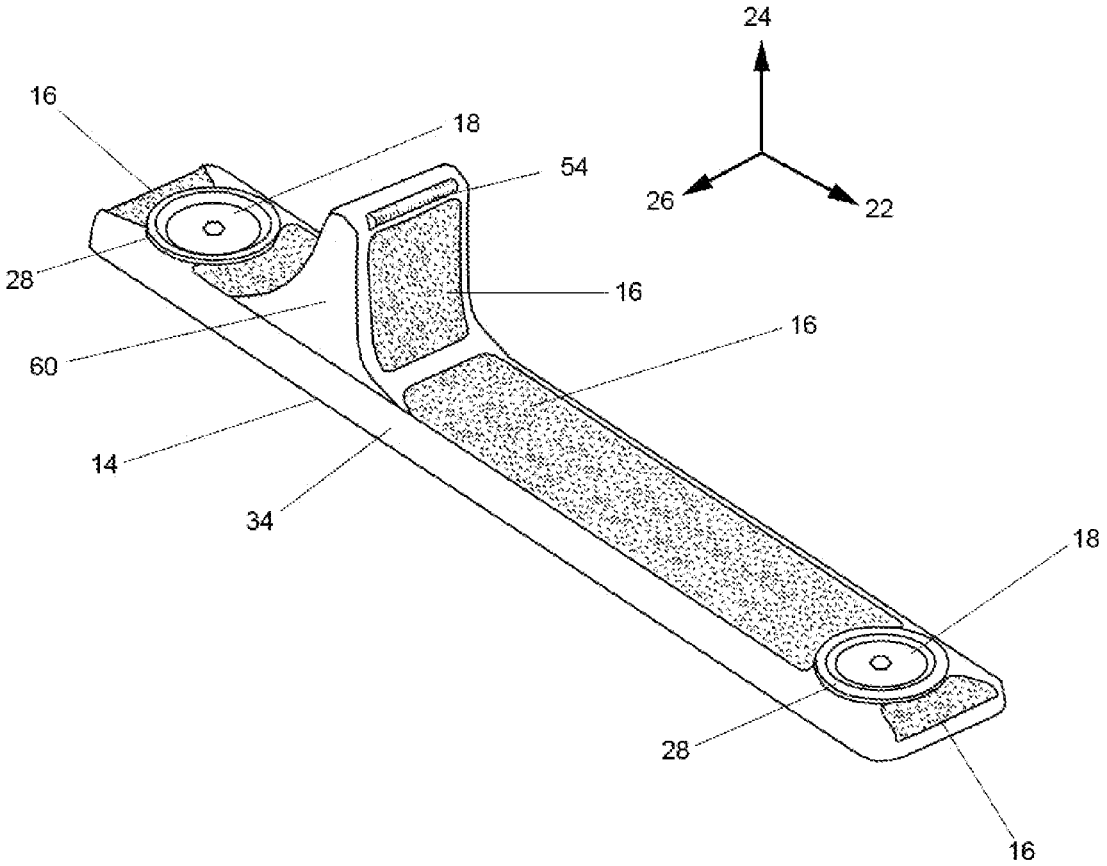
FIG. 10 shows a perspective view of an alternative embodiment of the panel in FIG. 2 featuring a hand-stop.

FIG. 10 shows a perspective view of an alternative embodiment of the panel 14 in FIG. 2 with a hand-stop 60. To assist in this description, an axes system is defined whereby the arrow at 22 indicates the horizontal axis, the arrow at 24 indicates the vertical axis, and the arrow at 26 indicates the lateral axis. The hand-stop 60 juts out vertically from the panel 14 and may feature one or more inlaid textured surface layers 16. The hand-stop 60 may vary in vertical height but it is contemplated that the hand-stop's 60 vertical height may be between 3 mm to 15 mm in some embodiments. The hand-stop 60 has several functions. Firstly, the hand-stop 60 may be used to allow the shooter's hand (not shown) to apply direct, rearward force according to the horizontal axis 22 upon the panel 14, thereby allowing the shooter (not shown) to better control recoil of the gun (not shown). Secondly, it may be used as an anchor point on inanimate objects (not shown) such as using the top-most part of the hand-stop 60 to push into a sandbag (not shown) to increase stability. Because the hand-stop 60 juts outward vertically in a prominent manner and because the hand-stop 60 may feature one or more inlaid textured surface layers 16, it is contemplated that the hand-stop 60 may incorporate one or more anti-snag ridges 54 in close proximity to the textured surface layer. The use of an inlaid textured surface layer 16 on the hand-stop 60 will boost the direct-rearward force the hand-stop 60 is able to generate while an anti-snag ridge 54 prevents the textured surface layer 16 from contacting unintended objects (not shown).

Figure 11:
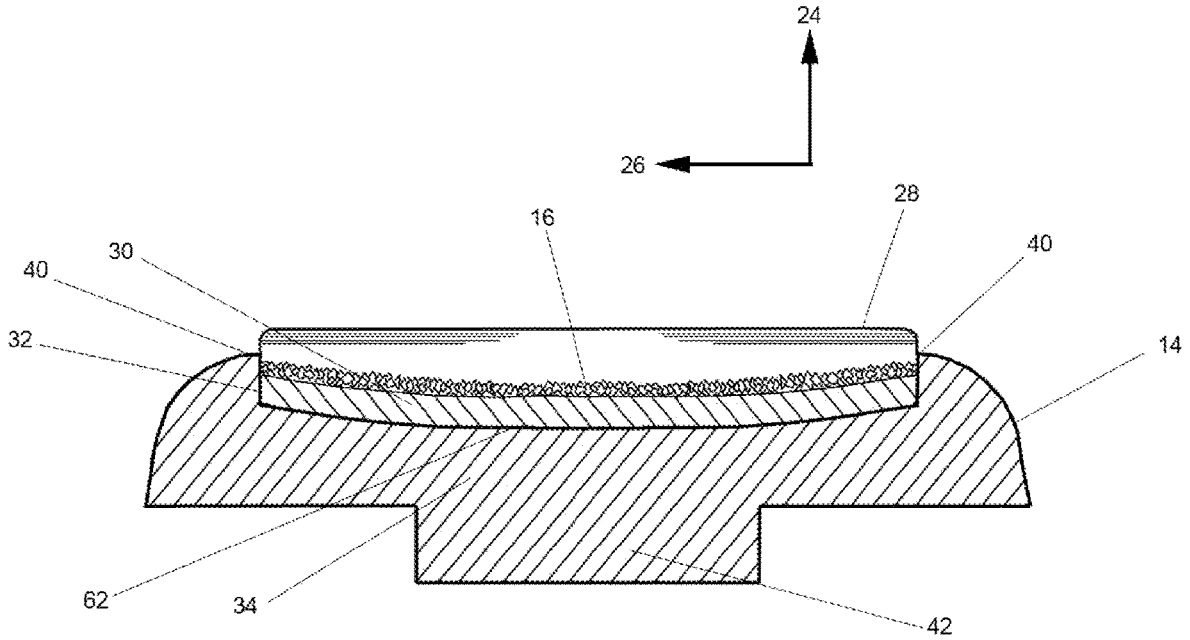
FIG. 11 shows a sectional view of an alternative embodiment of the panel in FIG. 2 with a curved recessed region.

FIG. 11 shows a sectional view of an alternative embodiment of the panel 14 in FIG. 2 taken at the sectioning plane and in the direction indicated by section lines 3-3. An axes system is defined whereby the arrow at 24 indicates the vertical axis and the arrow at 26 indicates the lateral axis. The panel 14 features a curved recessed region 62. The curved recessed region 62 has its vertically lowest point near the middle point of the curved recessed region 62 as opposed to its outermost edges. The curved nature of the curved recessed region 62 causes the adhesive layer 30 to assume the same slope as the curved recessed region 62. In turn, the curved recessed region 62 not only causes the adhesive layer 30 to slope accordingly but also causes the textured surface layer 16 to do the same. Imparting a curve to the inlaid textured surface layer 16 increases its surface area and causes the shooter's hand (not shown) to better engage the textured surface layer 16 resulting in a dramatically firm grip from using an approximately concave shape.

Figure 12:
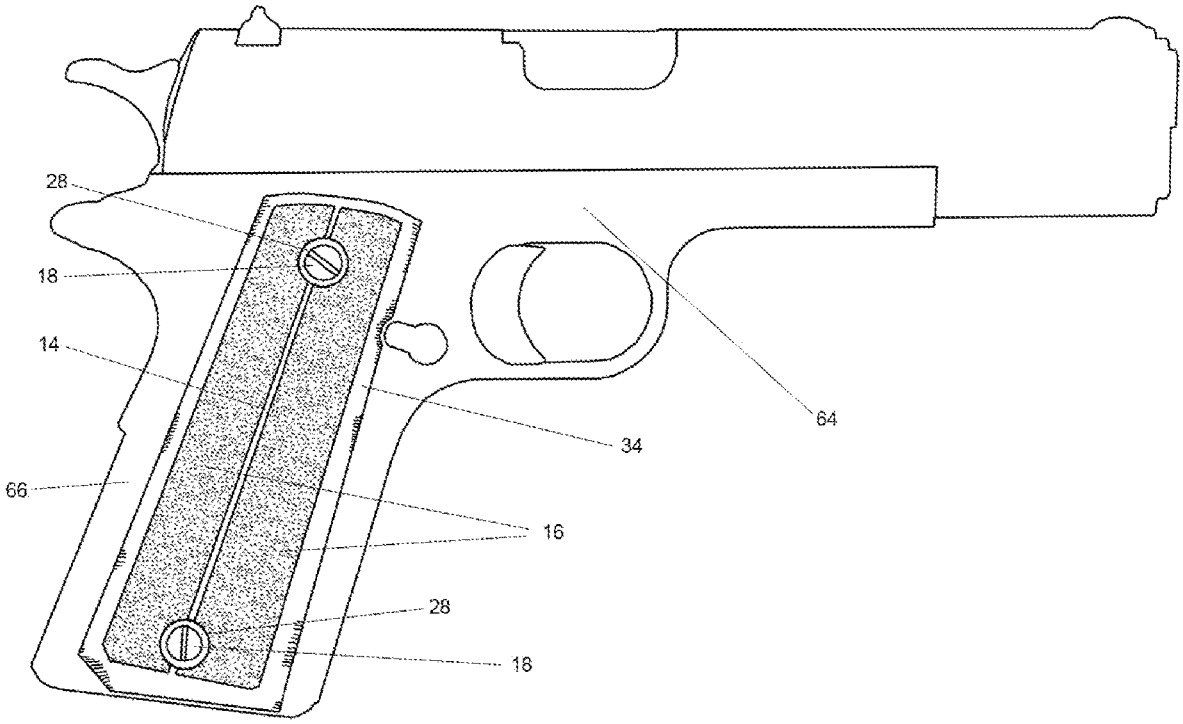
FIG. 12 shows an alternative embodiment of the panel in FIG. 1 configured for use on the grip region of a handgun.

FIG. 12 shows an alternative embodiment of the panel 14 in FIG. 1 configured for use on the handgun grip region 66 of a handgun 64. As opposed to being affixed to a handguard (not shown) as FIG. 1 illustrates, FIG. 12 shows the panel shaped according to the handgun grip region 66 and is affixed to the handgun 64 and is shaped accordingly. In this embodiment of the panel 14, the inlaid textured surface layers 16 can be seen along with fasteners 18 which attached the panel base 34 to the handgun 66. Surrounding each fastener 18 are mounds 28 to prevent lessen the shooter's hand (not shown) from directly contacting the fasteners 18. The advantage of the inlaid textured surface layers 16 on a panel 14 mounted to a handgun 66 is immense—not only does the inlaid texture surface 16 provide aggressive grip, but their inlaid nature reduces the overall width of the panel 14 and reduces snagging when the handgun 66 is worn in a holster (not shown).

Figure 13:
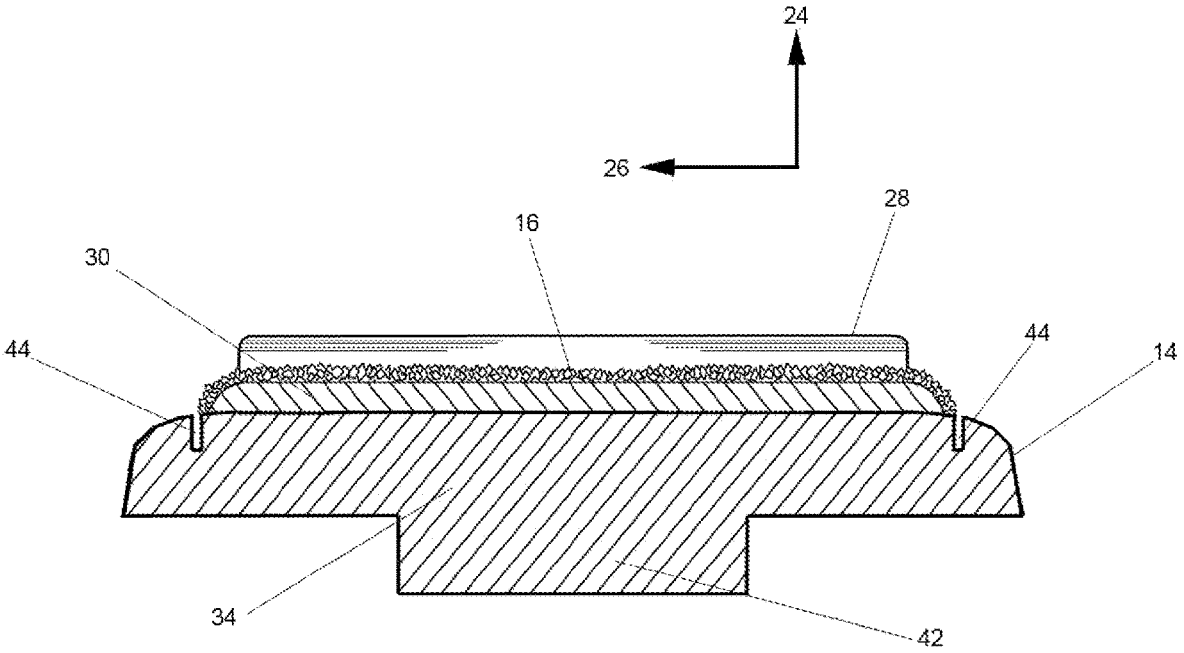
FIG. 13 shows a sectional view of an alternative embodiment of the panel in FIG. 2 configured for using an onlaid textured surface layer.

FIG. 13 shows a sectional view of an alternative embodiment of the panel 14 in FIG. 2 taken at the sectioning plane and in the direction indicated by section lines 3-3. The panel 14 features a textured surface layer 16 that is onlaid (as opposed to an inlaid). An axes system is defined whereby the arrow at 24 indicates the vertical axis and the arrow at 26 indicates the lateral axis. To maximize grip as well as thermal resistance of the panel 14, the adhesive layer 30 is atop the panel base 34 and substantially covers most of the vertical-facing top-most portion of it. On top of the adhesive layer 30, the textured surface layer 16 is added. The result is a textured surface layer with a large surface area that therefore offers plenty of grip, yet due to the generous amount of adhesive layer 30, which is contemplated to have low thermal conductivity, prevents heat from propagating quickly through the panel 14. Additionally, and optionally, to assist with manufacturing, it is contemplated that, when using an onlaid method (as opposed to inlaid) of inserting the adhesive layer 30 and then the textured surface layer 16, it is likely that the panel 14 would need to be masked off with some sort of masking tape (not shown). To assist with this, it is anticipated that the use of deep trenches 44 may be placed where the edges of the textured surface layer 16 are expected to begin or end. These deep trenches 44 are laterally thin but vertically deep and allow for a knife's edge (not shown) to engage them, thereby cutting through any masking tape (not shown) with precision and ease.

Although the description above contains many specificities, these should not be construed as limiting the scope of embodiments but as merely providing illustrations of some of several embodiments. It will be apparent to those skilled in the art that various modifications and variations can be made to the disclosed panel. Other embodiments will be apparent to those skilled in the art from consideration of the specification and practice of the disclosed panel. It is intended that the specification and examples be considered as exemplary only.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

The invention claimed is:

1. A panel configured to be affixed to a gun having a panel interface point, the panel comprising:

a panel base having an attaching side and a grip side;

said attaching side having at least one fastener securing said panel base to said panel interface point;

said grip side having at least one recessed region having a predetermined depth;

said recessed region having recessed region walls and being covered with an adhesive layer having a predetermined height;

said recessed region walls inclined toward said adhesive layer; said recessed region walls overhang part of said recessed region;

said adhesive layer being covered with an inlaid textured surface layer having a predetermined height, one or more mounds surround said fasteners, said one or more mounds create an empty space above said fasteners, and whereby the combined predetermined height of said adhesive layer and predetermined height of said inlaid textured surface layer are less than or equal to the predetermined depth of said recessed region; and said inclined recessed region walls prevents said adhesive layer from spreading above said predetermined height of said adhesive layer.

2. The panel of claim 1, wherein said inlaid textured surface layer comprises silicon carbide, aluminum oxide, or boron carbide, and said adhesive layer comprises epoxy resin.

3. The panel of claim 1, wherein said adhesive layer adheres the recessed region to the inlaid textured surface.

4. The panel of claim 1, wherein said inlaid textured surface layer includes at least one item from the list consisting of: aluminum oxide, silicon carbide, and boron carbide.

* * * * *